US006109474A

United States Patent [19]

Haugen

[11] Patent Number: 6,109,474

[45] Date of Patent: Aug. 29, 2000

[54] FELT TAB FEEDER FOR NAILING GUN

[76] Inventor: Shane Haugen, P.O. Box 4044, Gulf Shores, Ala. 36547

[21] Appl. No.: 09/184,943

[22] Filed: Nov. 3, 1998

[51] Int. Cl.[7] ..... B65H 5/28

[52] U.S. Cl. ..... 221/71; 221/77; 411/162

[58] Field of Search ..... 221/25, 26–69, 221/71, 73, 77, 79, 30, 106, 253, 277; 411/162, 147, 149; 227/107

[56] References Cited

U.S. PATENT DOCUMENTS

| | | | |
|---|---|---|---|
| 4,410,103 | 10/1983 | Fuhrmeister | 221/25 |
| 5,067,865 | 11/1991 | Zylka et al. | 411/531 |
| 5,184,752 | 2/1993 | Zylka et al. | 221/1 |

*Primary Examiner*—Kenneth W. Noland

*Attorney, Agent, or Firm*—Siemens Patent Services

[57] ABSTRACT

Automatic feeding apparatus for feeding a coil of felt tabs connected in head to tail relation to a nailing or stapling gun. The feeder places one tab beneath the gun in the path of the next nail or staple to be driven by the gun such that operating the gun causes a felt tab to be installed simultaneously with the driven nail or staple. The feeding apparatus includes a clip for storing a coil of tabs, a tractor drive for advancing the coil one tab at a time when the gun is operated, and a motor for operating the tractor drive. The clip has a removable cover and an axle about which the coil of tabs rotates as it is paid out. The tractor drive has an endless belt from which fingers project to engage the tabs. Power is the same as that employed by the gun. The feeding apparatus may be integral with the gun or may have structure enabling ready attachment to the gun.

17 Claims, 7 Drawing Sheets

FELT TAB FEEDER FOR NAILING GUN

BACKGROUND OF THE INVENTION

1. Field of the Invention

The present invention relates to apparatus and method for dispensing felt tabs in conjunction with operating a nailing gun. One felt tab is held directly beneath the gun so that the operation of driving a nail simultaneously causes one felt tab to be penetrated and thereby pinned by the nail. The principal application of the invention is in the field of building construction, and more particularly, in assembly of roofing materials to roofs.

2. Description of the Prior Art

Roofs are typically constructed by installing weather resistant elements such as tar paper and roofing shingles on a supporting structural stratum such as plywood. Throughout most of the United States, these materials may be installed employing roofing nails and staples. Roofing nails are relatively short, broad headed nails. Staples, if employed, are of the type having a U-shape providing a relatively broad central member which bears against the article being fastened in a manner corresponding to that provided by the broad head of a roofing nail.

In certain parts of the United States, particularly those located where hurricanes and similar severe weather conditions are prevalent, building codes require that the surface area of the roofing material contacted by the nail be extended by provision of a felt tab. Felt tabs are so called because they typically lie on and secure felt or tar paper to the structural element of the roof. Conventional tabs are typically circular, and offer surface area considerably greater than that of the head of a roofing nail and the central member of a staple. When the roofing nail or staple is driven through the tab, a correspondingly greater area of the roof is securely engaged by the combined nail or staple and felt tab. The benefit of this process is similar in principal to that provided by placing a large flat washer beneath the head of a bolt or nail.

In traditional practice, felt tabs have been manually placed beneath a nailing gun. When the gun is fired, or operated, the felt tab is installed simultaneously with the roofing nail. This practice entails obvious hazards to the installer, and also is cumbersome and inefficient. Accordingly, the prior art has developed apparatus for automating feeding and placing of circular felt tabs beneath a nailing gun. The apparatus is attached to the gun, and causes one felt tab to be installed as the gun is operated.

This approach is shown in U.S. Pat. No. 5,067,865 and 5,184,752, issued to Karl H. Zylka et al. on Nov. 26, 1991, and Feb. 9, 1993, respectively. However, both apparatus and method of Zylka et al. differ from those of the present invention. Zylka et al. employs conventional, unconnected disc shaped tabs vertically stacked in a column. By contrast, the present invention employs a coil of detachably connected tabs. The novel apparatus unwinds the coil of tabs such that the tab located at the end of the coil is located directly beneath the path of the next nail or staple to be driven. Apparatus for unwinding a coil is obviously different from that appropriate for dispensing individual discs from a stack of unattached discs. In a further difference, the felt tabs themselves differ from the traditional disc configuration of felt tabs. The novel tabs are generally rectangular, attach to one another by thin, frangible joints, and have depressions formed in their broad faces for receiving prongs of drive apparatus employed to advance the coil.

None of the above inventions and patents, taken either singly or in combination, is seen to describe the instant invention as claimed.

SUMMARY OF THE INVENTION

The present invention sets forth method and apparatus for automatically feeding a felt tab to guns for dispensing nails, staples and other fasteners. The apparatus dispenses felt tabs such that one tab is automatically installed by the nailing or stapling gun each time a nail or staple is driven. The tabs are formed as a coil, or connected, spirally wound series of individual tabs connected serially in head to tail fashion. Connection of the tabs is by a frangible seam or joint that is ruptured by the relatively violent action of firing the nailing or stapling gun.

The dispensing apparatus comprises a tractor drive which engages the felt tabs. While most of the felt tabs are in the form of a spirally wound coil, the last few tabs are arrayed in a straight line, with the very last tab sitting beneath the next nail or staple awaiting driving. A tractor drive engages those tabs forming the straight line. The tractor drive is either pneumatically or electrically operated by the same power source operating the nailing or stapling gun. The tractor drive advances the coil in units of one tab, responsive to detection of firing of the gun. For pneumatic guns, a momentary drop in pneumatic pressure of the pneumatic supply is sensed. For electrically operated guns, momentary voltage drop is sensed.

Optionally, the dispensing apparatus can be manually reversed to withdraw the last felt tab from its position beneath the next nail or staple awaiting driving. This feature enables the operator of the gun to remove a misaligned or defective felt tab from the ready position, and to clear jams from the gun. In another option, the dispensing apparatus can be disabled by a switch or the like to enable the nailing or stapling gun to dispense nails or staples without dispensing felt tabs. This feature enables the operator to dispense fasteners with the nailing or stapling gun in situations other than those requiring felt tabs.

Individual felt tabs are generally rectangular, each tab attaching in serial or head to tail fashion to a leading tab at one end and to a trailing tab at the other end. Attachment is by a frangible seam or joint formed between adjacent tabs. Each tab has a depression formed on its broad face, for receiving prongs or other projections of the tractor drive. The depression has a ramp leading to the flat, broad face so that if the coil of tabs is manually reversed, the prong will not remain stuck in the depression. Rather, the prong rides up the ramp, coming to rest on the upper flat, broad face of the tab, thereby disengaging from the tab.

The novel tab dispensing apparatus can be provided either integrally with a nailing or stapling gun, or may be provided in a form readily attached to pre-existing nailing and stapling guns. The invention further comprises a novel configuration of felt tabs and a method of feeding these felt tabs to nailing and stapling guns.

Accordingly, it is a principal object of the invention to provide automatic felt tab feeding apparatus suitable for use with fastener driving guns.

It is another object of the invention that the feeding apparatus feed tabs one by one responsive to operation of a fastener driving gun.

It is a further object of the invention to dispense tabs from serially connected felt tabs which can be wound in an elongate coil.

Still another object of the invention is to operate the feeder from the same power source as that powering a fastener driving gun.

An additional object of the invention is to engage serially connected tabs by a finger.

It is a further object of the invention to enable the feed apparatus to be reversed for clearing jams and defective tabs from the feed apparatus.

Yet another object of the invention is to enable the feeder mechanism to be attached to pre-existing fastener driving guns.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
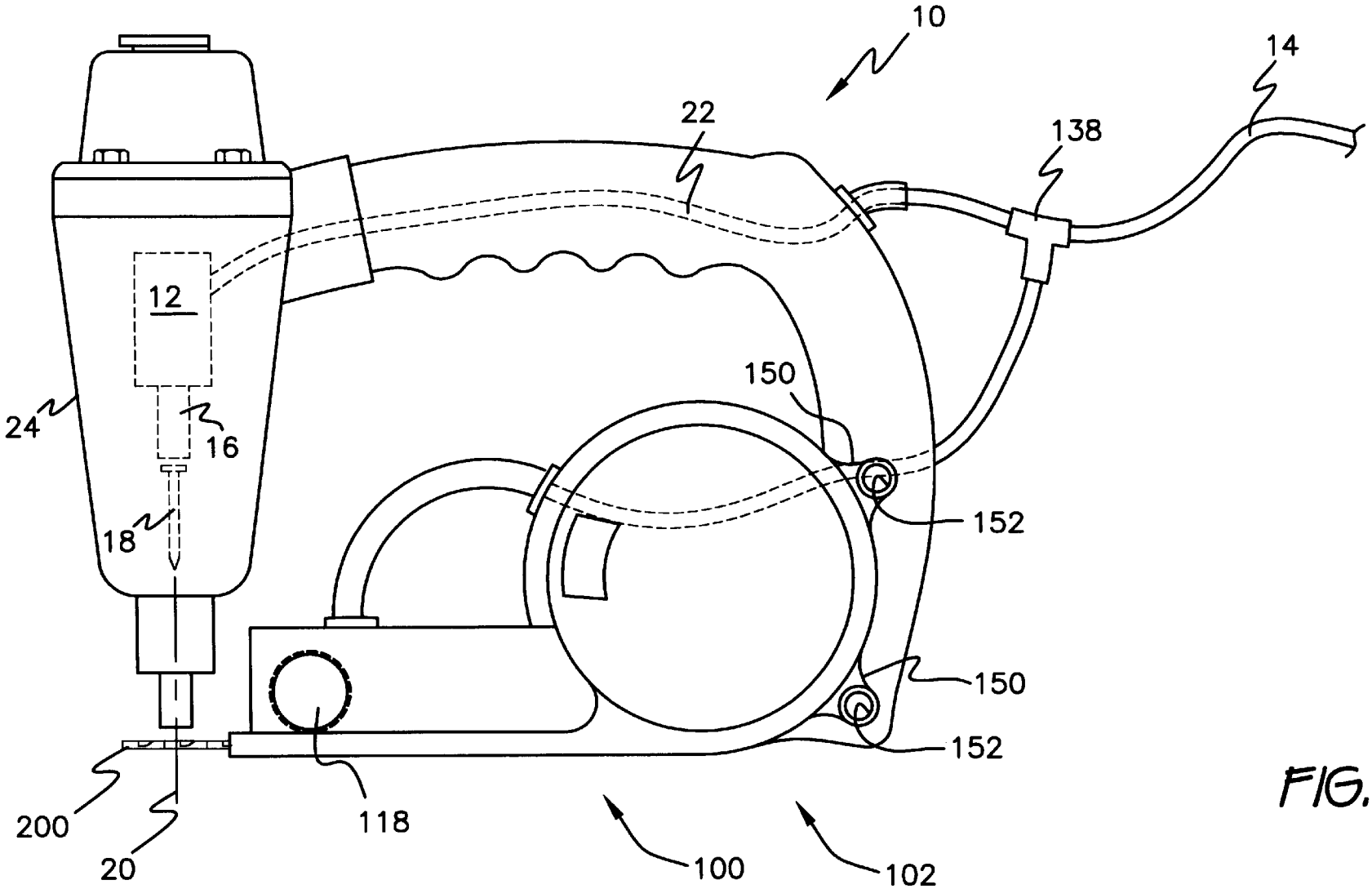
FIG. 1 is a diagrammatic, side elevational view of a nailing gun provided with a felt tab feeding apparatus.

FIG. 1 of the drawings shows a representative fastener driving gun 10 of a commercially available type commonly employed to drive nails. It will be understood that gun 10 could equally be of a type to drive staples (not shown) or still other fasteners. Gun 10 may be any fastening driving gun which dispenses a fastener by imparting linear propulsion to the fastener. Gun 10 is conventional, and certain components thereof will be described merely to explain their cooperation with the novel feed apparatus. Gun 10 includes propulsion apparatus, such as a conventional pneumatic driver 12 which is connected to a power source such as external supply conduit 14 connected to a source of compressed gas. An internal conduit 22 connects conduit 14 to driver 12. Driver 12 moves piston 16 rapidly downwardly, as depicted in FIG. 1, to subject a nail 18 to an impact of sufficient force to drive nail 18 downardly into a plywood sheet (not shown) or other structural element of a roof.

Nail 18 is one of many nails (others not shown) awaiting driving, and is stored in a conventional magazine (not shown) or other holding chamber. Gun 10 will be understood to include conventional components such as an operator's button or trigger, safety interlock disabling operation unless gun 10 is pressed against the plywood sheet, and other structural elements, although these components are omitted for brevity.

Figure 3:
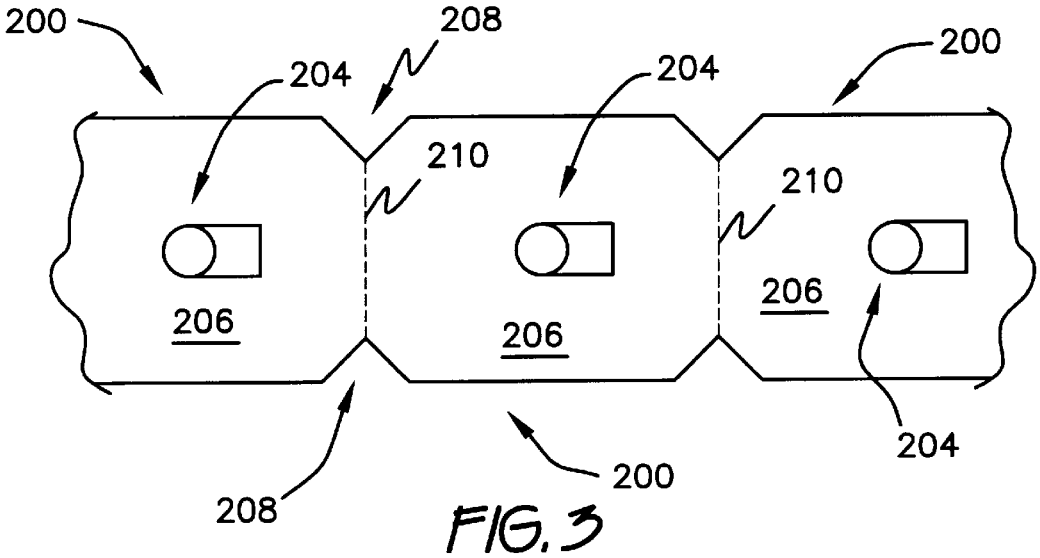
FIG. 3 is a top plan detail view of the felt tabs of FIG. 2.
Figure 2:
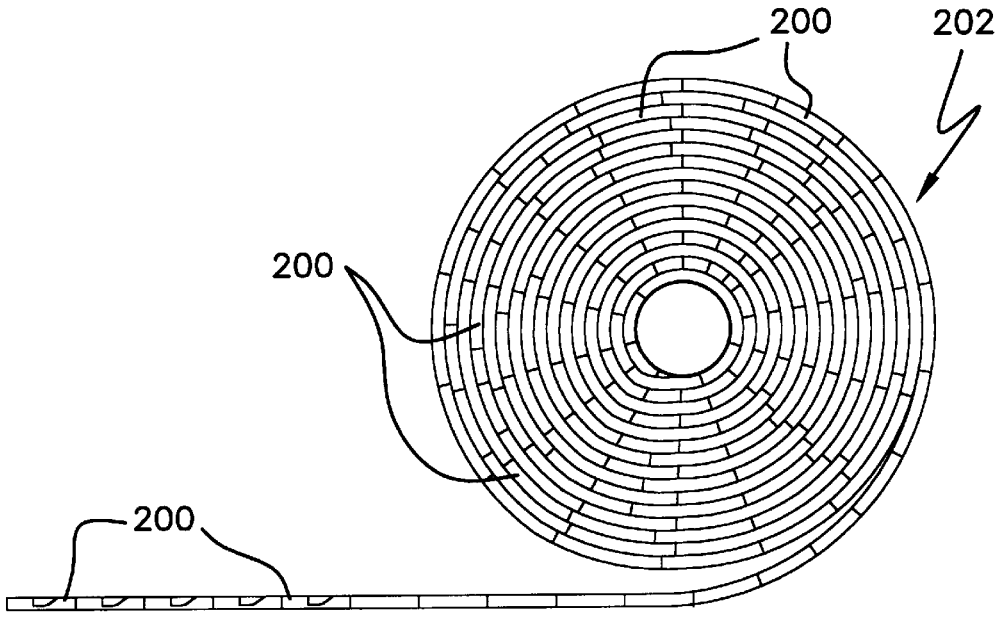
FIG. 2 is a side elevational view of felt tabs arranged as they would be in the feeding apparatus of FIG. 1.

Gun 10 is provided with an automatic feed apparatus 100 which feeds felt tabs 200 to gun 10 such that one felt tab 200 sits directly beneath and in the path of nail 18. The path of nail 18 is that along which nail 18 will travel when struck by piston 16. The path is indicated by broken line 20. Apparatus 100 dispenses individual felt tabs 200 which are formed in a coil 202 of serially connected individual felt tabs 200, as shown in FIG. 2. FIG. 3 illustrates felt tabs 200 in greater detail. Each felt tab 200 has a depression 204 located on a broad surface or face 206. Each felt tab 200 has two notches 208 and a frangible joint or seam 210 disposed between adjacent felt tabs 200. Notches 208 and seam 210 cooperate to enable felt tabs 200 to be readily broken away from an adjacent felt tab 200 when struck by nail 18 as nail 18 is driven by piston 16. Seam 210 is sufficiently strong to secure felt tabs 200 in their connected condition, and sufficiently flexible to enable connected felt tabs 200 to be wound in coil 202 shown in FIG. 2.

Figure 4:
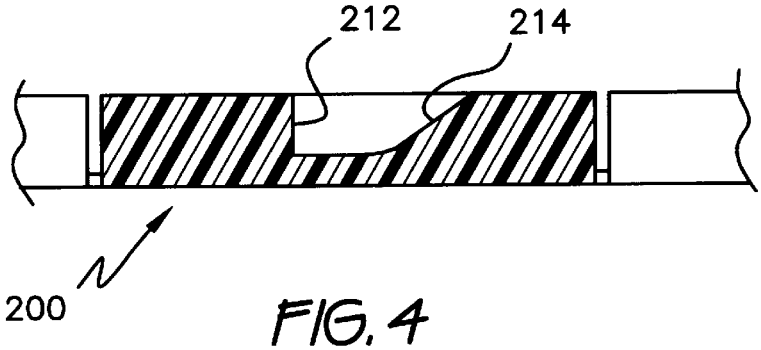
FIG. 4 is a side elevational detail view of FIG. 3, shown partially in cross section.

Looking at individual felt tab 200, as shown in FIG. 4, depression 204 has a section with upright walls 212, and an inclined wall or ramp 214. These features of depression 204 cooperate with a driver in a manner to be explained hereinafter.

Figure 5:
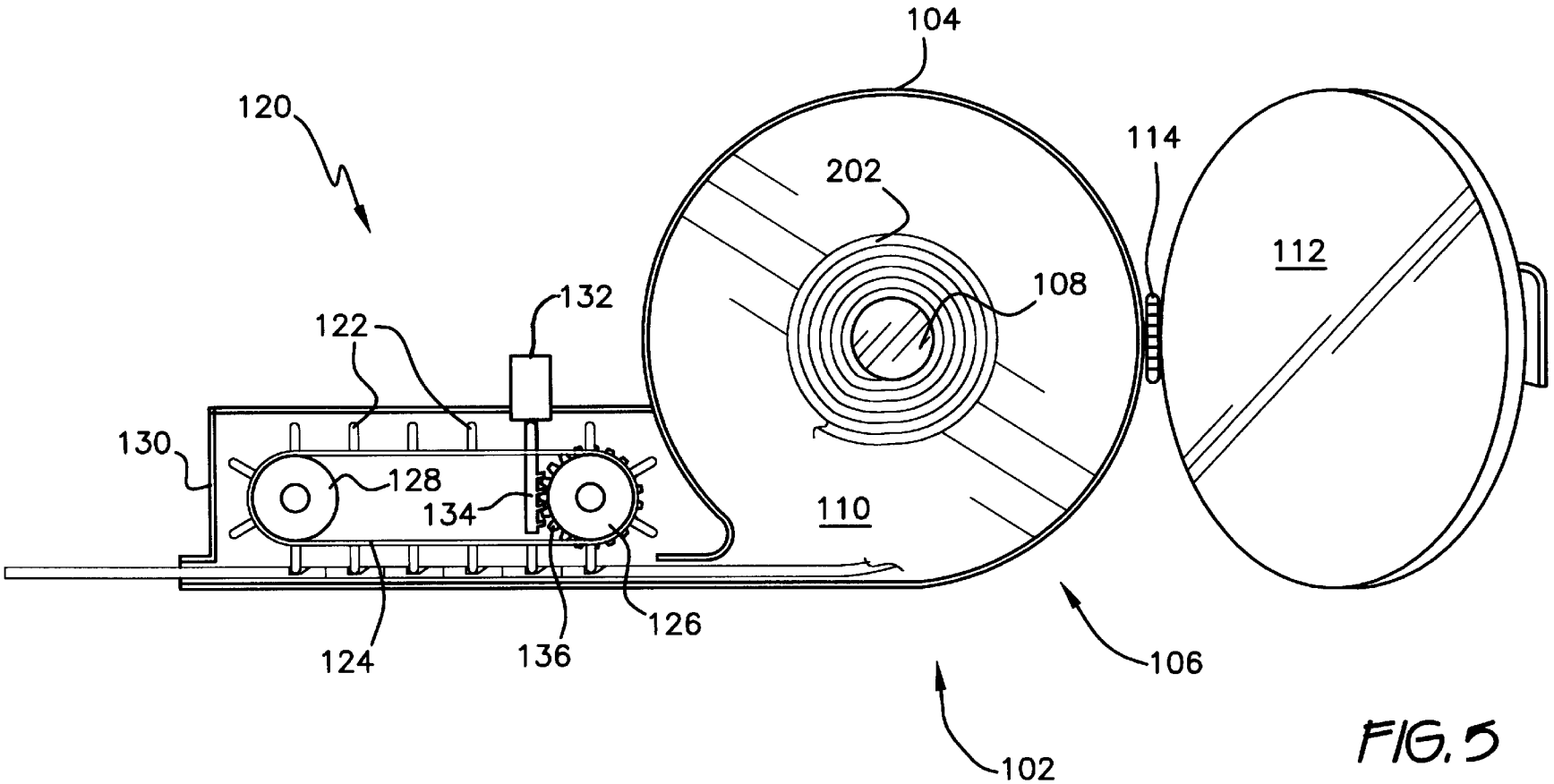
FIG. 5 is a diagrammatic, side elevational, mostly cross sectional view of the feeding apparatus shown at the lower right of FIG. 1.

Returning to FIG. 1, a clip 102 is fixed to gun 10. Clip 102 contains coil 202 and dispenses felt tabs 200 such that one felt tab 200 is located beneath nail 18. FIG. 5 illustrates internal detail of clip 102. Clip 102 is seen to have an outer wall 104 enclosing an open interior 106 which is dimensioned and configured to hold and unreel coil 202. Coil 202 is supported on an axle 108 projecting from rear wall 110 of clip 102. Coil 202 is prevented from falling out of clip 102 by a removable cover 112. Cover 112 is removed or opened to replenish coil 202. Cover 112 is removable in that it reveals interior 106. It does not necessarily have to be separable from clip 102. Cover 112 may, for example, be attached to clip 102 by a hinge 114. If desired, cover 112 could be removably attached to clip 102 by spring arm clips (not shown), threaded fastener (not shown), or in any other suitable way enabling ready manual opening and closing of interior 106.

FIG. 5 also shows a driver 120 which advances felt tabs 200 of coil 202. Driver 120 has engagement elements which engage felt tabs 200. Driver 120 includes a motive element to move the engagement elements in a direction paying out felt tabs 200, that being the direction causing coil 202 to unreel. In the embodiment of FIG. 5, driver 120 is a tractor drive wherein engagement elements are provided by fingers 122 projecting from an endless belt 124. Each finger 122 will come to occupy and engage one depression 204 of an associated felt tab 200. When belt 124 is rotated such that fingers 122 located on the lower side of belt 124 move to the left, they will abut the forward walls 212 of their associated depressions 204, and propel the engaged felt tabs 200 to the left, thereby unreeling coil 200.

From time to time, it may be necessary to rotate belt 124 in a direction opposite that of ordinary operation, or reverse belt 124. This may be required to clear a jam or to perform other service to gun 10. This is accomplished by turning a suitable manual control such as knob 118 (see FIG. 1), which is fixed to driver 120 in any suitable way. Knob 118 may also be employed to make manual adjustments, where necessary, to assure that the foremost felt tab 200 is in its proper position beneath nail 18.

Some felt tabs 200 of coil 202 are engaged at any one time by fingers 122. As belt 124 rotates, fingers 122 will advance coil 202 such that succeeding felt tabs 200 are progressively positioned beneath nail 18.

Endless belt 124 is supported on two rotatable wheels 126, 128. Wheels 126, 128 are suitably journaled in housing 130 which encloses the tractor drive. Wheel 128 is driven by knob 118 for reversing and adjusting belt 124. Wheel 126 is rotated by the motive element. In the embodiment of FIG. 5, the motive element is a pneumatically operated piston and cylinder assembly 132. When the piston (not separately shown) is propelled downwardly by introduction of compressed gas into assembly 132, a ratchet arm 134 engages teeth 136 fixed to wheel 126, and rotates wheel 126 to a predetermined limited degree. The amount of rotation imparted by each stroke of the piston and ratchet arm 134, and the distance by which coil 202 advances corresponds to the length of one felt tab 200. This assures that as each felt tab 200 is replaced by the next, the newly positioned felt tab 200 will be properly positioned beneath nail 18.

Figure 6:
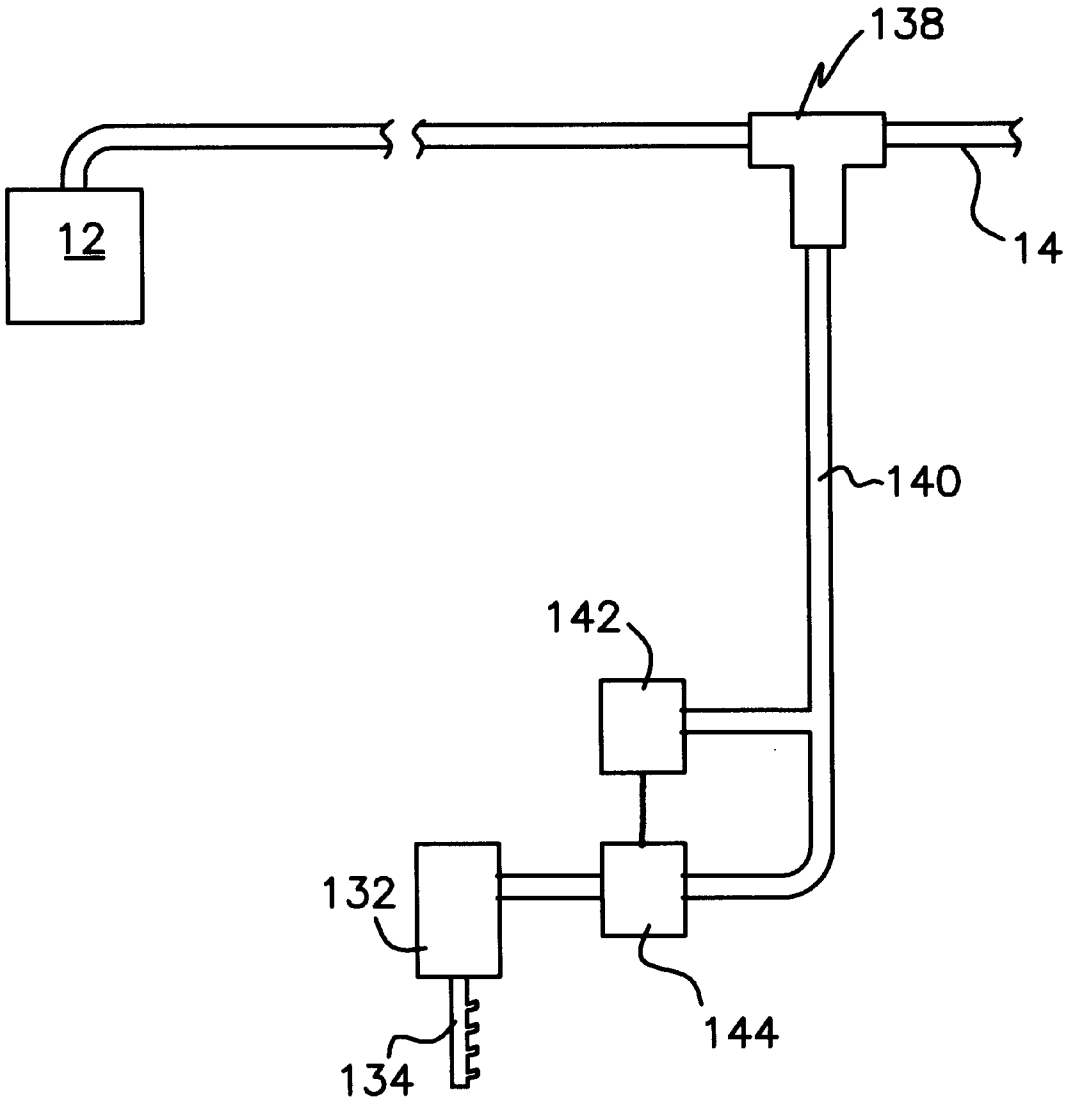
FIG. 6 is a schematic diagram of the pneumatic system of the embodiment of FIG. 1.

Operating power is connected to piston and cylinder assembly 132 by the following arrangement. It is desired, but not necessary, that assembly 132 be powered by the same power source operating piston 16 of gun 10. FIG. 6 shows this arrangement diagrammatically. A tee fitting 138 is interposed between supply conduit 14 and internal conduit 22, thereby tapping the source of compressed gas. A conduit 140 conducts compressed gas to a sensor, such as pressure transducer 142, and to a controller, such as a valve 144.

When transducer 142 senses a drop in operating pressure, which would occur when gun 10 drives nail 18, transducer 142 opens valve 144. Pressure of the compressed gas is then communicated to piston and cylinder assembly 132. The piston then moves ratchet arm 134 to advance coil 202. Transducer 142 is arranged to introduce a suitable delay so that there is no interference between, on one hand, piston 16 of gun 10 and nail 18 being driven, and on the other hand, that felt tab 200 which is being moved to the ready position beneath a new nail 18. The controller, by timing or duration of operation or in any other suitable way, operates the motive element such that the coil of felt tabs is advanced by the distance of the length of one felt tab 200.

FIG. 1 illustrates an embodiment of the invention wherein automatic feed apparatus 100 is separate from fastener driving gun 10, and is adapted to be retrofit to a pre-existing gun 10. To this end, apparatus 100 has tabs 150 bearing holes 152. Tabs 150 are located to align with screws or other fasteners (none shown) originally employed to assemble housing 24 of gun 10. Apparatus 10 may be installed to a conventional gun 10 by removing the screws or other fasteners, and reinstalling the screws, passing them through holes 152 of tabs 150.

Figure 7:
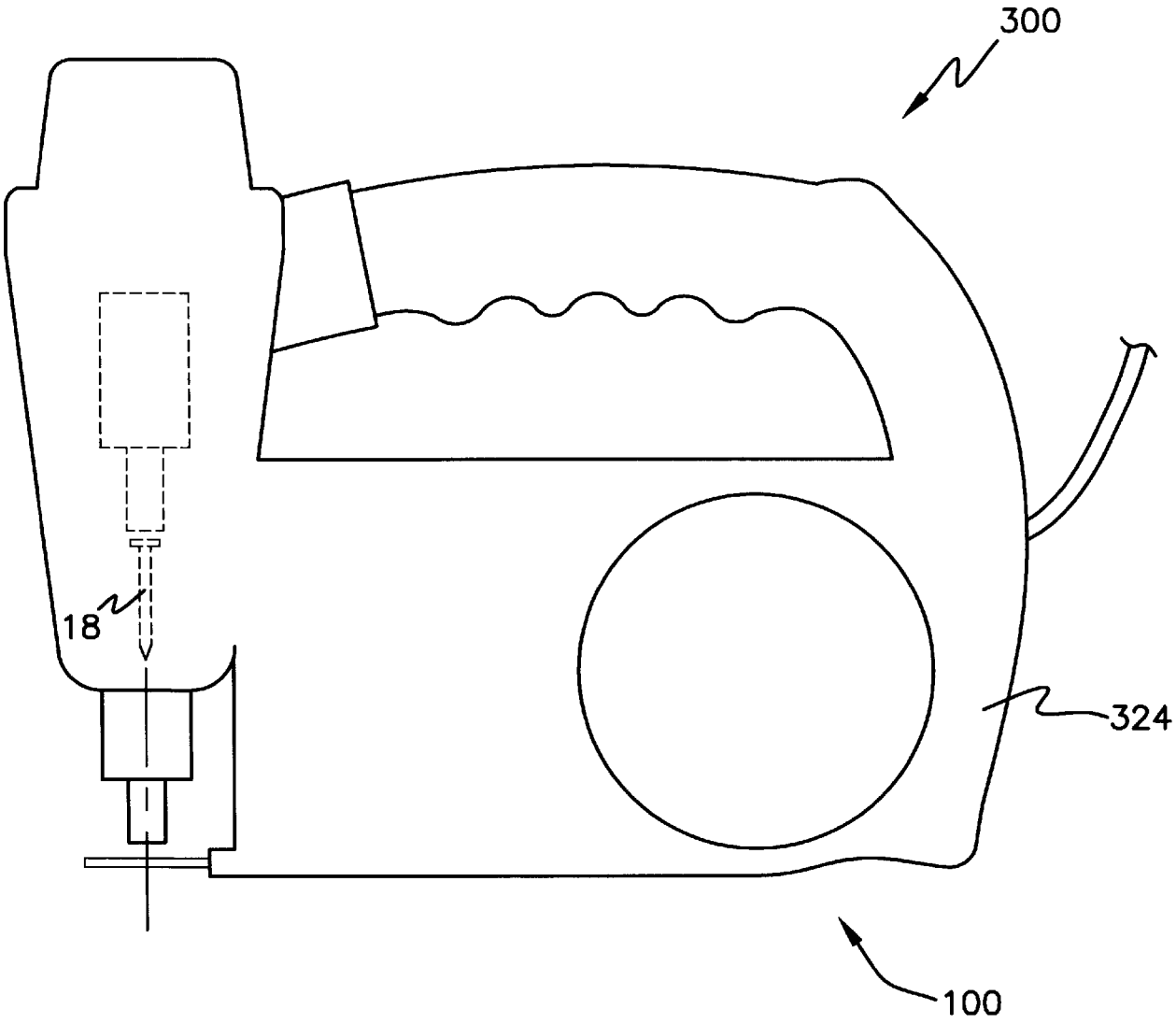
FIG. 7 a diagrammatic, side elevational view of an alternative embodiment of the invention.

Of course, it is possible to form a fastener driving gun 300 to include feed apparatus 100 as an integral part. As shown in FIG. 7, this is performed by configuring housing 324 of gun 300 to enclose the operative components of apparatus 100 as well as those of the fastener driving gun itself. It will be understood that gun 300 has all of the features of conventional gun 10, and incorporates all of the features of automatic feeding apparatus 100.

Figure 8:
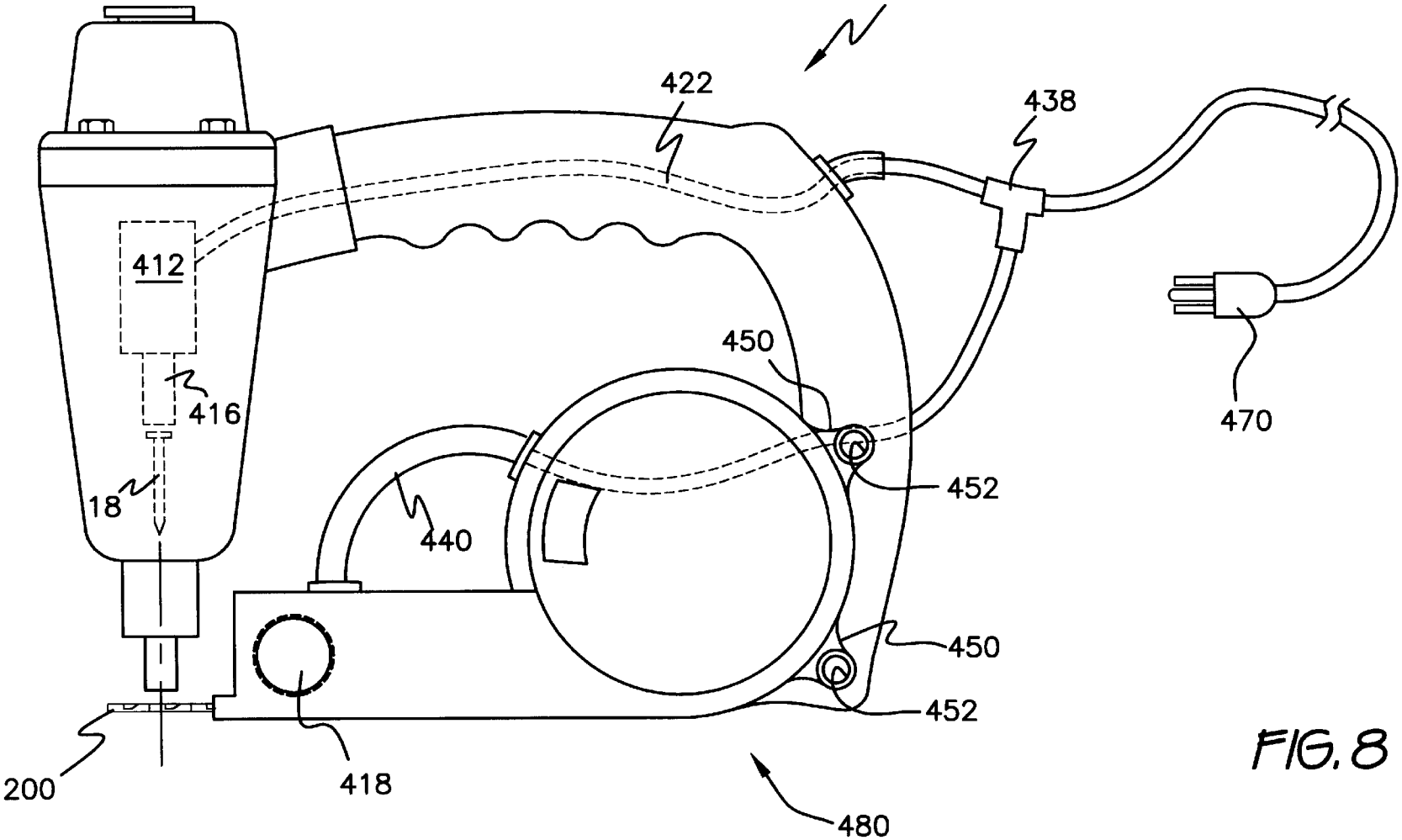
FIG. 8 is a diagrammatic, side elevational view of an electrically operated fastener driving gun incorporating the present invention.

Thus far, the invention has been described in terms of pneumatic power. Some conventional fastener driving guns operate by electrical power. The novel felt tab feeding apparatus is readily adapted to electrically operated guns. An electrically operated fastener driving gun 400 is shown in FIG. 8. Gun 400 incorporates all the features of a conventional electrically operated driving gun (not shown) as well as the features of feeding apparatus 100. Propulsion apparatus of gun 10, which is pneumatic driver 12, is replaced by a motor or solenoid 412 served by an electrical cable 422 rather than the pneumatic conduit 22 of gun 10. In other functional aspects, gun 400 is similar to gun 10, but with accommodation of electrical power rather than pneumatic power.

Gun 400 may be a conventional electrically operated fastener driving gun not originally provided with a felt tab feeder. In this instance, an electrically operated felt tab feed apparatus 480 is provided. Feed apparatus 480 attaches to gun 400 by tabs 450 bearing holes 452 in a manner similar to that in which feed apparatus 100 attaches to gun 10. Of course, an electrically operated fastener driving gun may be formed to incorporate feed apparatus 480 integrally, in a manner similar to gun 300 of FIG. 7.

In gun 400, an electrical feeding apparatus 480 replaces pneumatic feed apparatus 100 of gun 10. Fitting 138 of gun 10 is replaced by a tee splice 438. Conduit 140 of gun 10 is replaced by conductors 440. Power is obtained by terminating cable 422 in a cord and plug assembly 470.

Figure 9:
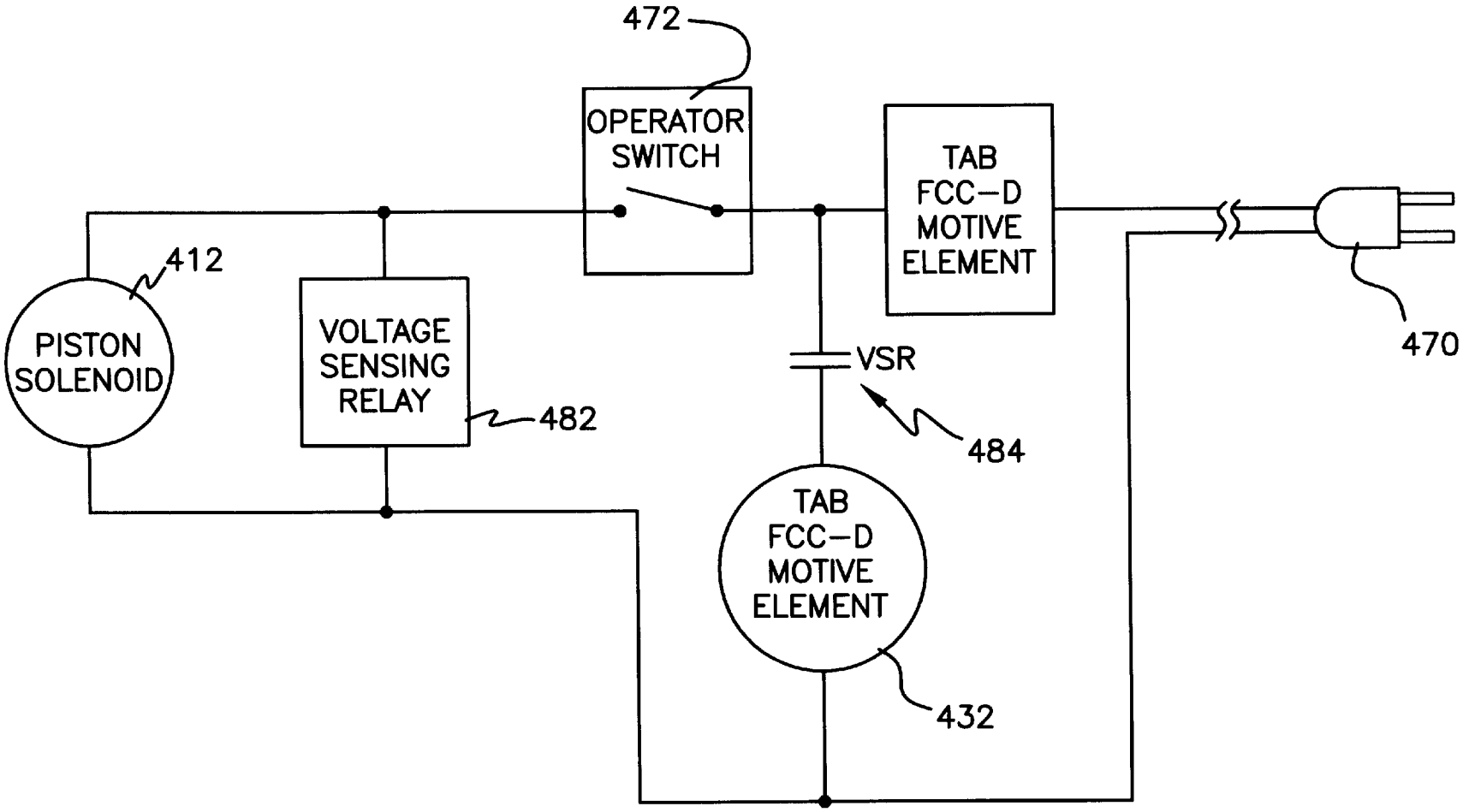
FIG. 9 is a schematic diagram showing power and control circuitry of the embodiment of FIG. 8.

Similarly, and referring now to FIG. 9, pneumatic piston and cylinder assembly 132 of gun 10 is replaced in gun 400 by a solenoid 432 to accommodate electrical power. The power circuit is closed by a conventional manual operating switch 472, which operates piston solenoid 412 when plug and cord assembly 470 has been connected to electrical power. A voltage sensing relay 482 senses voltage drop in the circuit to solenoid 412. Normally open contacts 484 of relay 482 close to energize tab feed motive element 432, which is a solenoid. Contact closure occurs after a suitable delay to avoid interference between piston 416, which is driven by propulsion apparatus 412, and a new felt tab 200.

Felt tab feed apparatus 480 may be modified to be operated in ways other than that set forth above. For example, voltage sensing relay 482 may be replaced by another sensor (not shown), such as a limit switch or any other device which senses operation of propulsion apparatus 412. Operation of tab feed motive element may be controlled by that switch operating propulsion apparatus 412, again with a suitable delay introduced to avoid interference between piston 416 and a new felt tab 200.

Obviously, the present invention may be employed with fasteners other than nails and staples. Any fastening driving gun which dispenses a fastener by imparting linear propulsion to the fastener may incorporate the present invention.

It is to be understood that the present invention is not limited to the embodiments described above, but encompasses any and all embodiments within the scope of the following claims.

I claim:

1. Automatic feed apparatus for feeding felt tabs formed in a coil of serially connected individual felt tabs to a fastener driving gun, wherein the fastener driving gun has a power source and a fastener awaiting driving, said automatic feed apparatus comprising:

a clip having an outer wall and an open interior dimensioned and configured to hold and unreel the coil of tabs;

a driver having engagement elements disposed to engage some of the felt tabs of the coil and a motive element disposed to move said engagement elements in a direction causing the coil of felt tabs to unreel, power connection means for operating said motive element from the power source of the fastener driving gun; and attachment means for attaching said clip and said driver to the fastener driving gun such that one unreeled felt tab is positioned in linear alignment with the fastener awaiting driving with respect to the fastener driving gun such that the fastener will pass through the one unreeled felt tab.

2. The automatic feed apparatus according to claim 1, wherein said clip has an axle disposed within said open interior disposed to support the coil of felt tabs, and a removable cover for enabling replenishment of felt tabs.

3. The automatic feed apparatus according to claim 1, further including a sensor disposed to sense when the fastening driving gun drives a fastener, wherein said driver includes a controller operating said motive element responsive to said sensor sensing when the fastening driving gun drives a fastener.

4. The automatic feed apparatus according to claim 3, wherein said controller operates said motive element such that the coil of felt tabs unreels a distance equivalent to the length of one felt tab when one fastener is driven by the fastener driving gun.

5. The automatic feed apparatus according to claim 1, wherein the fastener driving gun is pneumatically operated and includes a supply conduit for conducting pressurized gas to the fastener driving gun, and wherein said power connection means include a fitting attachable to the supply conduit of the fastener driving gun, said fitting enabling fluid communication between the supply conduit of the fastener and said power connection means.

6. The automatic feed apparatus according to claim 3, wherein the fastener driving gun is electrically operated and includes electrical circuitry conducting electrical power to the motor of the fastener driving gun, and wherein said sensor senses energization of the motor of the fastener driving gun and is disposed to operate said motive element responsive to energization of the motor of the fastener driving gun.

7. The automatic feed apparatus according to claim 1, wherein said driver comprises a tractor drive having an endless belt, and said engagement elements of said driver comprise fingers projecting from said endless belt in a location to engage the felt tabs.

8. The automatic feed apparatus according to claim 1, further comprising a manual control disposed to reverse said driver, so that jams can be cleared from said automatic feed apparatus.

9. Automatic feed apparatus for feeding felt tabs formed in a coil of serially connected individual felt tabs to a fastener driving gun, wherein the fastener driving gun has a power source and a fastener awaiting driving, said automatic feed apparatus comprising:

a clip having an outer wall and an open interior dimensioned and configured to hold and unreel the coil of tabs, wherein said clip has an axle disposed within said open interior disposed to support the coil of felt tabs, and a removable cover for enabling replenishment of felt tabs;

a driver having engagement elements disposed to engage some of the felt tabs of the coil and a motive element disposed to move said engagement elements in a direction causing the coil of felt tabs to unreel, power connection means for operating said motive element from the power source of the fastener driving gun, wherein said driver comprises a tractor drive having an endless belt, and said engagement elements of said driver comprise fingers projecting from said endless belt in a location to engage the felt tabs;

attachment means for attaching said clip and said driver to the fastener driving gun such that one unreeled felt tab is positioned in linear alignment with the fastener awaiting driving with respect to the fastener driving gun such that the fastener will pass through the one unreeled felt tab;

a sensor disposed to sense when the fastening driving gun drives a fastener, wherein said driver includes a controller operating said motive element responsive to said sensor sensing when the fastening driving gun drives a fastener, wherein said controller operates said motive element such that the coil of felt tabs unreels a distance equivalent to the length of one felt tab when one fastener is driven by the fastener driving gun; and a manual control disposed to reverse said driver, so that jams can be cleared from said automatic feed apparatus, wherein the fastener driving gun is pneumatically operated and includes a supply conduit for conducting pressurized gas to the fastener driving gun, and wherein said power connection means include a fitting attachable to the supply conduit of the fastener driving gun, said fitting enabling fluid communication between the supply conduit of the fastener and said power connection means.

10. A fastener driving gun for driving fasteners into an environmental object and for installing felt tabs by driving a fastener through each felt tab, said gun comprising:

a fastener holder having a chamber for storing fasteners;

propulsion apparatus disposed to drive the fasteners from said fastener holder into the environmental object;

a power source operably connected to said propulsion apparatus;

automatic feed apparatus for feeding felt tabs formed in a coil of serially connected individual felt tabs to said propulsion apparatus of said fastener driving gun, said automatic feed apparatus comprising a clip having an outer wall and an open interior dimensioned and configured to hold and unreel the coil of tabs;

a driver having engagement elements disposed to engage some of the felt tabs of the coil and a motive element disposed to move said engagement elements in a direction causing the coil of felt tabs to unreel, power connection means for operating said motive element from the power source of the fastener driving gun, and attachment means for attaching said clip and said driver to said fastener driving gun such that one unreeled felt tab is positioned in linear alignment with the fastener awaiting driving with respect to said fastener driving gun such that the fastener will pass through the one unreeled felt tab when said fastener driving gun drives a fastener.

11. The fastener driving gun according to claim 10, wherein said clip has an axle disposed within said open interior disposed to support the coil of felt tabs, and a removable cover for enabling replenishment of felt tabs.

12. The fastener driving gun according to claim 10, further including a sensor disposed to sense when said fastening driving gun drives a fastener, wherein said driver includes a controller operating said motive element responsive to said sensor sensing when said fastening driving gun drives a fastener.

13. The fastener driving gun according to claim 12, wherein said controller operates said motive element such that the coil of felt tabs unreels a distance equivalent to the length of one felt tab when one fastener is driven by said fastener driving gun.

14. The fastener driving gun according to claim 10, wherein said power source of said fastener driving gun is pneumatically operated and includes a supply conduit for conducting pressurized gas to said propulsion apparatus, and wherein said power connection means include a fitting attachable to said supply conduit of said fastener driving gun, said fitting enabling fluid communication between said supply conduit of said fastener driving gun and said power connection means of said driver.

15. The fastener driving gun according to claim 12, wherein said fastener driving gun is electrically operated, said propulsion apparatus includes an electric motor and includes electrical circuitry conducting electrical power to said electric motor, and wherein said sensor senses energization of said electric motor and is disposed to operate said motive element responsive to energization of said electric motor.

16. The fastener driving gun according to claim 10, wherein said driver comprises a tractor drive having an endless belt, and said engagement elements of said driver comprise fingers projecting from said endless belt in a location to engage the felt tabs.

17. The fastener driving gun according to claim 10, further comprising means for reversing said driver, so that jams can be cleared from said automatic feed apparatus.

* * * * *